United States Patent [19]

Karrer

[11] Patent Number: 4,702,014

[45] Date of Patent: Oct. 27, 1987

[54] METHOD OF AND AN APPARATUS FOR DRYING FIBROUS MATERIAL

[76] Inventor: Fritz Karrer, Strandvägen 37, 11456 Stockholm, Sweden

[21] Appl. No.: 748,151

[22] Filed: Jun. 24, 1985

[30] Foreign Application Priority Data

Jun. 25, 1984 [DE] Fed. Rep. of Germany ..... 3423388

[51] Int. Cl.[4] ..... F26B 7/00

[52] U.S. Cl. ..... 34/15; 34/92; 34/104

[58] Field of Search ..... 34/15, 92, 36, 104, 34/105; 68/5 C, 18 R, 20

[56] References Cited

U.S. PATENT DOCUMENTS

| | | | |
|---|---|---|---|
| 1,902,575 | 3/1933 | Nichols | 34/15 |
| 2,266,375 | 12/1941 | Mengeringhausen | 34/15 |
| 2,432,952 | 12/1947 | Scherpenzeel | 34/92 |
| 2,539,943 | 1/1951 | Breazeale | 34/92 |
| 2,574,298 | 11/1951 | Smith | 34/51 |
| 2,871,574 | 2/1959 | Thies | 34/54 |
| 3,522,663 | 8/1970 | Grimmelt | 34/54 |
| 3,528,180 | 9/1970 | Karrer et al. | 34/15 |
| 3,631,691 | 1/1972 | Karrer et al. | 34/104 |
| 3,927,478 | 12/1975 | Karrer et al. | 34/104 |
| 4,075,765 | 2/1978 | Karrer et al. | 34/212 |
| 4,197,657 | 4/1980 | Leino et al. | 34/51 |
| 4,242,808 | 1/1981 | Luthi | 34/35 |
| 4,385,450 | 5/1983 | Thomas et al. | 34/104 |
| 4,527,343 | 7/1985 | Danneberg | 34/16 |

FOREIGN PATENT DOCUMENTS

| | | |
|---|---|---|
| 1635211 | 6/1971 | Fed. Rep. of Germany . |
| 2010605 | 9/1971 | Fed. Rep. of Germany . |
| 1927651 | 6/1976 | Fed. Rep. of Germany . |

*Primary Examiner*—Albert J. Makay
*Assistant Examiner*—David W. Westphal
*Attorney, Agent, or Firm*—Michael J. Striker

[57] ABSTRACT

Fibrous material is dried in a vessel 1 by passing vapor through the same which is circulated in a circulation conduit 26, superheated in a continuous flow heater 20 and circulated by a fan 16. A vacuum pump 31 is connected to the circulation conduit 26 by a pressure control valve 32.

14 Claims, 1 Drawing Figure

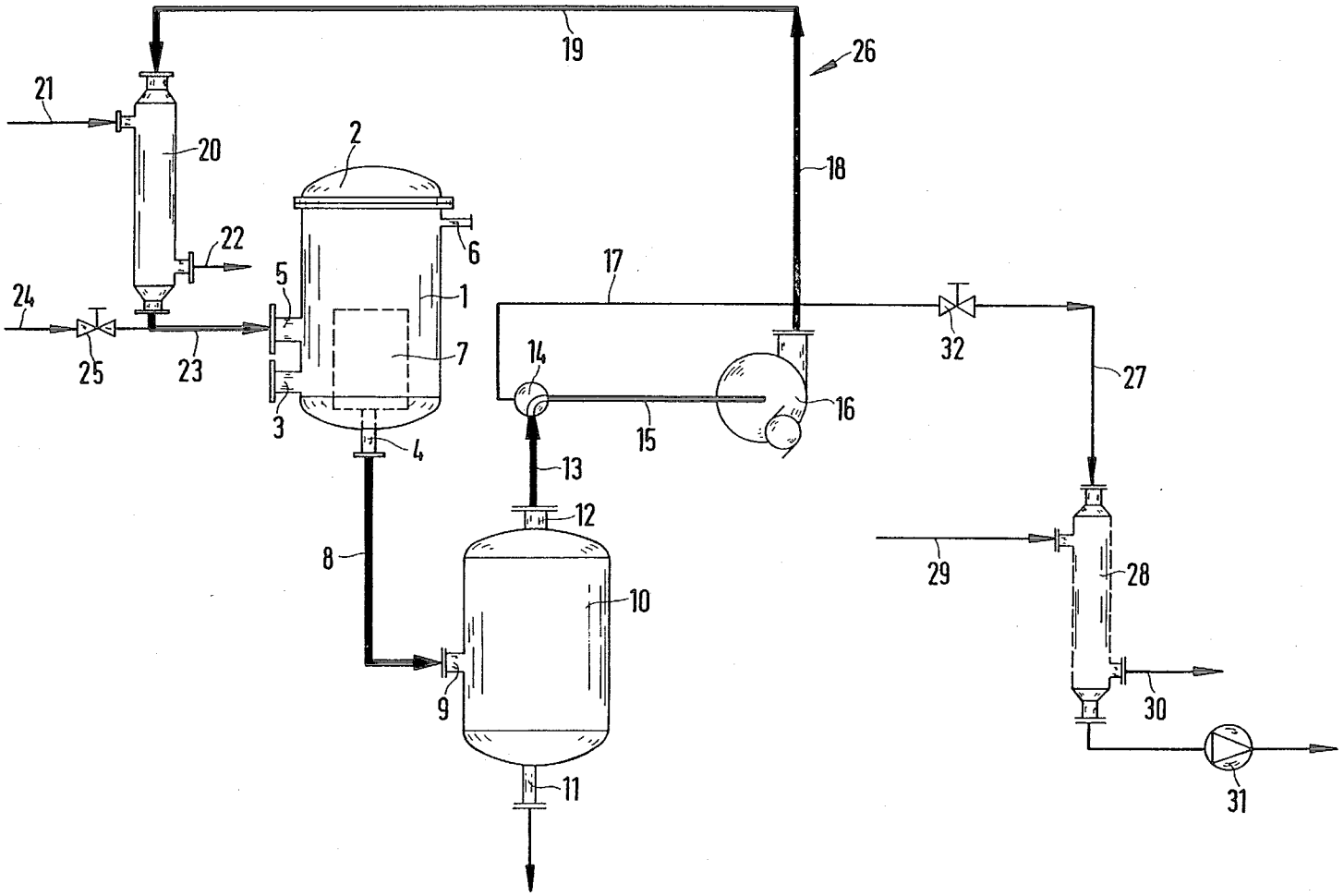
1
2
3
4
5
6
7
8
9
10
11
12
13
14
15
16
17
18
19
20
21
22
23
24
25
26
27
28
29
30
31
32

METHOD OF AND AN APPARATUS FOR DRYING FIBROUS MATERIAL

The invention relates to a method of drying fibrous material and the like, especially following liquid treatment, like dyeing of the fibrous material, while keeping the fibrous material in the treatment vessel and, if desired, subjecting it to the flow of air and/or vapor for mechanical dehydration to a residual moisture and subsequently finish drying it by applying sub-atmospheric pressure and introducing vapor, the moisture withdrawn from the fibrous material being discharged to the vacuum pump or to a condenser coordinated with the vacuum pump.

Such a method is known (DE-OS No. 19 27 651). In that case textile fiber material, such as yarn in the form of cross-wound bobbins is dyed in a treatment vessel and subsequently dried without being transferred to another container. To this end initially mechanical dehydration is provided with which air and/or vapor or steam flow through the fibrous, material, entraining unevaporated moisture from the fibrous material by way of droplets. The separation of the droplets from the fibrous material is enhanced by simultaneous vacuum in the vessel.

Following such mechanical dehydration, any residual moisture in the fibrous material is removed by thermal finish-drying. Again vacuum exists in the vessel and heated air is passed through the fibrous material, on the one hand applying heat to evaporate the residual moisture and, on the other hand, taking up steam from the fibrous material and discharging it to the vacuum pump. This moisture condenses either in a condenser upstream of the vacuum pump or in the vacuum pump itself if the latter, for instance, is a liquid seal pump. During this finish drying no additional steam or vapor or only a small amount thereof is introduced into the vessel or the fibrous material to be dried, apart from the heated This vapor or steam substantially is not superheated and, apart from limited heat supply to the fibrous material, serves to avoid local over-drying thus yielding more uniform finish drying.

Finish drying by means of heated air requires not only an air heater but also a vacuum pump of comparatively great capacity to process the rather great quantities of air needed for the desired quick finish drying. This adds to the relevant expenses for the equipment comparatively high operating costs caused not only by the required high vacuum pump performance but also by a correspondingly great amount of exhaust air of elevated temperature obtained downstream of the vacuum pump.

It is, therefore, an object of the invention to carry out the known method such that finish drying of the fibrous material is accomplished quickly and without difficulty at rather low expenditure for equipment and low operating costs.

This object is met, in accordance with the invention, in that exclusively superheated steam is passed continuously through the fibrous material during the finish drying, supplying the heat required for evaporation of the residual moisture and flowing off together with the residual moisture evaporated from the fibrous material.

As the finish drying according to the invention does without the flow through of heated air, the plant becomes simpler. Where fibrous material is being dried, usually vapor or even superheated steam is available.

The superheating may be achieved also by lowering the pressure by the use of a vacuum pump. It is a decisive advantage of carrying out the method without the use of drying air that the vacuum pump need not handle corresponding amounts of air and that no output of moist hot air is required. Instead, the vacuum pump merely aspires steam which may be used in operation upon having been condensed to warm water. The quantity of exhaust steam or condensate can be kept low and is substantially restricted to the amount of residual moisture to be discharged because the drying can be realized without any additional live steam, as will be explained below.

An especially convenient realization of the method provides for passing the steam in circulation through the fibrous material and a reheater, a proportion of the steam corresponding to the vapor formation of the residual moisture being withdrawn from the circulation to the vacuum pump. The heat needed for evaporation of the residual moisture is conveyed by the circulating steam from the reheater to the fibrous material. It is obvious that this circulated steam may well be the evaporated residual moisture so that not only the supply of superheated drying air but also the supply of vapor or steam from outside optionally may be dispensed with. This is made possible because a first evaporation of the residual moisture can be obtained by a corresponding great pressure reduction in the vessel by means of the vacuum pump. In this context it is advantageous if the fibrous material has been preheated by heat transfer from the air and/or steam used in the mechanical dehydration which precedes the finish drying. If desired, this preheating may be almost up to the boiling point which corresponds to the steam pressure characteristic.

If the drying is effected in this manner by steam flowing in the circulation system, it is convenient to withdraw the steam proportion to the vacuum pump at a place downstream of the fibrous material and the circulation means and upstream of the reheater in the direction of circulation. Conveniently the steam porportion is withdrawn to the vacuum pump through a pressure control valve which opens as the pressure rises in the circulation system. This assures both good circulation of the steam by means of the reheater and sufficient discharge of steam to the vacuum pump while, at the same time, maintaining the given operational low pressure in the treatment vessel and in the circulation system.

The method according to the invention permitting short drying times, it is useful the carry out the drying in the treatment vessel as this involves rather little work and high treatment capacity still is available at comparatively short drying periods. The method according to the invention is suitable not only for drying yarns or textile fabrics but also, quite generally, for drying material which is adapted to be penetrated by media flows, such as paper fabric or wood fiber material.

The invention also relates to an apparatus for carrying out the method described above, comprising a vessel which receives the fibrous material for flow through the same, a circulation conduit in which the vessel, a circulation means, and a continuous flow heater are installed, and a branch conduit connected to the circulation conduit and including a vacuum pump and an optional condenser and an optional live steam supply line opening into the circulation conduit.

Such an apparatus comprising a condenser and a live steam supply line is already known (DE-OS No. 20 10

605). In that case the live steam supply line opens into the circulation system by way of a steam cooler which serves for mechanical dehydration rather than finish drying. The steam is highly expanded so that it will have a great specific volume at low density and, therefore, the amount of steam passed through the textile material to be dried, although being relatively small, flows through the material at high velocity which has been found convenient for mechanical dehydration by the entrainment of water droplets. In spite of the high flow velocity in passing the material the vacuum pump is not loaded very much since the quantity of steam to be handled is small and is condensed upstream of the vacuum pump. However, the finish drying in this case, too, is effected by heated air which is supplied even under elevated pressure. The supply of heat to the fibrous material by circulated air under elevated pressure alternates with the evaporation of residual moisture from the fibrous material and discharge thereof to the vacuum pump by connecting said vacuum pump. Thus the circulating line including the heater and the circulation means, on the one hand, and the branch line including the vacuum pump, on the other hand, are adapted to be connected and disconnected alternatingly. Yet this way of proceeding does not permit the realization of the method in accordance with the invention which provides for the continuous flow of dry steam through the fibrous material and the discharge of part of the steam to the vacuum pump in the interest of rapid drying of the fibrous material.

The known apparatus has been modified by the invention such that a pressure control valve is inserted in the branch conduit for regulating the low pressure applied by the vacuum pump in the circulation conduit.

This measure makes it possible to have nothing but steam flow through the fibrous material during the finish drying and, at the same time, branch off a proportion of the circulating steam to the vacuum pump.

Convenient modifications and further developments of the apparatus reside in the use of a steam operated heat exchanger as the continuous flow heater, a continuous flow cooler inserted in the branch line being embodied by a water operated heat exchanger, a dehydration tank, including a liquid discharge line installed in the circulation conduit downstream of the vessel and upstream of the branch conduit leading to the vacuum pump, and the connection of the branch conduit to the circulation conduit downstream of the circulation means and upstream of the continuous flow heater.

An embodiment of the invention will be described further below with reference to a diagrammatic drawing of a plant for dyeing and drying textile material.

The plant shown comprises a vessel 1 provided with a lid 2 and including an inlet 3 for treatment liquid, an outlet 4, a connection 5 for the introduction of a drying medium, and a nozzle 6 for the connection of pressurized air. Also shown in the vessel 1 is the fibrous material to be treated, for example yarn on a cross-wound bobbin 7. The vessel 1 is so designed and the fibrous material so disposed, both in per se known manner, that flow communication is established between the inlet 3, the connection 5, and the nozzle 6, on the one hand, and the outlet 4 on the other hand, exclusively through the fibrous material 7.

The outlet 4 is connected by an outlet conduit 8 to the inlet nozzle 9 of a dehydration tank 10 having a liquid discharge 11 at the bottom and a gas outlet opening 12 at the top.

A line 13 from the gas outlet 12 is connected selectively by a switch-over valve 14 to the suction line 15 of a fan 16 or to a bypass line 17 which bypasses the fan 16. A blowing line 18 is connected to the fan 16 and the bypass line 17 opens into the blowing line.

The blowing line 18 leads to a connecting line 19 to a continuous flow heater 20 embodied by a steam heated heat exchanger to which a heating steam supply line 21 is connected as well as a condensate discharge line 22.

The flow path which is the continuation of the connecting line 19 through the continuous flow heater 20 is connected by a supply line 23 to the inlet 5 of the vessel 1. A live steam supply line 24 opens into the supply line 23 and is adapted to be blocked by a shut-off valve 25.

It follows from the above description and from the illustration that the lines 8,13,15,18,19, and 23 form a circulation conduit 26 in which the vessel 1 is connected as well as the dehydration tank 10, the fan 16, and the continuous flow heater 20.

A branch conduit 27 is connected to the circulation conduit 26 or its blowing line 18. This branch conduit 27 is connected to a vacuum pump 31 by way of a continuous flow cooler 28 having a cooling water inlet 29 and a cooling water outlet 30. A pressure control valve 32 is inserted in the branch conduit 27 between the circulation conduit 26 and continuous flow cooler 28. This valve is adjustable to a desired low pressure which is then maintained in the circulation conduit 26 by means of the vacuum pump 31. Of course, the low pressure is not the same at every location within the circulation system because of the flow resistances in the circulation conduit 26.

Textile fibrous material may be dyed and dried as follows in the plant described above:

First the fibrous material 7 is introduced into the vessel 1 which then is evacuated by means of the vacuum pump 31. Subsequently dyeing liquor is introduced into the vessel 1 through the inlet 3. The action of the dyeing liquor on the fibrous material 7 may be enhanced in per se known manner by having the dyeing liquor circulate through the fibrous material 7. It is likewise possible to apply pulsating pressure shocks, for instance, by way of the nozzle 6. Pressurized air flowing into the vessel 1 may press the dyeing liquor out of the vessel 1 after the intended time of action or the dyeing liquor may run out into the dehydration tank 10 and through the liquid discharge line 11 thereof. The fibrous material 7 is washed in similar manner, the washing water for instance being introduced into the vessel through the inlet 3. If desired, a plurality of dyeing and/or washing procedures may be implemented.

After the washing the fibrous material 7 is dried in the vessel 1. This drying is carried out in two steps, the first one being a mechanical dehydration followed by thermal finish drying. In both cases the vacuum pump 31 is used to maintain low pressure in the vessel 1 so as to promote the drying.

Steam and/or pressurized air are introduced into the vessel 1 by way of the live steam supply line 24 or the nozzle 6, respectively, for the mechanical dehydration. These media remove moisture from the fibrous material 7 in the form of droplets which they entrain. This moisture is separated in the dehydration tank 10 or it flows through the bypass line 17 and the branch conduit 27 to the vacuum pump 31 if the switch-over valve 14 is adjusted accordingly. If the dehydration is effected by air, separation takes place just like condensation takes place if steam is used as the mechanical dehydration medium. The steam introduced through the live steam supply line 24 not only has a mechanical dehydrating effect but also causes preheating of the fibrous material and any residual moisture within the same, optionally in combination with partial condensation in the fibrous material 7.

The subsequent finish drying is a thermal drying process during which steam is caused to flow through the fibrous material 7 and is heated in correspondence with the low pressure established by means of the vacuum pump 31 so that the residual moisture will evaporate. With the switch-over valve 14 in the position shown the steam forming in the fibrous material 7 is circulated through the circulation conduit 26 when the fan 16 is running. This steam is superheated in the continuous flow heater 20. This results in further evaporation of residual moisture, and a corresponding proportion of steam is withdrawn from the circulation system and carried off through the branch conduit 27 to the vacuum pump 31. The pressure control valve 32 takes care of the transfer of this steam proportion to the vacuum pump. The course of the finish drying may be influenced in the course of the drying period by varying the adjustment of the pressure control valve 32 and of the heat supply in the continuous flow heater 20 in order to obtain adaptation to the degree of dryness of the fibrous material 7 and achieve as quick and careful drying as possible of the fibrous material 7.

It is evident that the finish drying may take place entirely without any supply of live steam. Therefore, possibly the live steam supply line 24 including the shut-off valve 25 and also the bypass line 17 including the switch-over valve 14 may be dispensed with. Residual moisture in the fibrous material 7 may be evaporated as early as the beginning of the finish drying by use of the vacuum pump 31. The resulting steam may be circulated through the circulation conduit 26 with the aid of the fan 16, thus conveying heat from the continuous flow heater 20 to the fibrous material 7.

The plant as shown and described corresponds to a testing plant designed to dry 2 kg of yarn containing 2.5 kg of water within 30 minutes. A continuous flow heater 20 is provided which has a heat exchange surface of 2.5 $m^2$. The fan 16 has a delivery efficiency of 8 $m^3$/min. and a pressure differential of 0.1 bar. The circulating steam is characterized by a density of 0.3 $kg/m^3$, a pressure of 0.5 bar, and a temperature of 80° C.

In another embodiment the fan 16 has a delivery efficiency of 17.5 $m^3$/min. at a differential pressure of 0.1 bar. In that event the density is 0.13 $kg/m^3$, the pressure is 0.203 bar, and the temperature 60° C.

The above statements, naturally, are just examples which are variable within wide limits.

What is claimed is:

1. A method of drying a textile fibrous material containing a residual liquid, comprising the steps of heating the fibrous material exclusively by superheated steam circulated by circulation means through a circulation conduit, a vessel containing the fibrous material and a reheater, applying underpressure by a vacuum pump to the heated material at subatmospheric pressures so that the residual liquid contained within the fibrous material vaporizes, withdrawing vaporized liquid from the heated material together with the circulating steam, and intermittently withdrawing a portion of the steam from the circulation conduit corresponding to the vaporized liquid by the vacuum pump through a pressure control valve which opens as the pressure rises in the circulation conduit to a predetermined higher subatmospheric value and which closes as the pressure drops to a predetermined lower subatmospheric value.

2. The method as claimed in claim 1, wherein the steam portion is withdrawn to a vacuum pump at a place downstream of the fibrous material and the circulation means and upstream of the reheater in the direction of circulation.

3. The method as claimed in claim 2 wherein the steam portion is withdrawn to the vacuum pump through a pressure control valve which opens as the pressure rises in the circulation means.

4. The method as claimed in claim 1, further comprising:

adjusting the pressure control valve and heat supplied by the continuous flow heater to suit a degree of dryness of the fibrous material.

5. A method as defined in claim 1 wherein said fibrous material is first treated by a dyeing liquid in a vessel, then subjected to a mechanical dehydration to a residual liquid.

6. An apparatus for drying a fibrous material containing a residual liquid, comprising a vessel (1) which receives the fibrous material (7), a circulation conduit (26) in which the vessel (1), a circulation means (16) and a continuous flow heater (20) are installed, and a branch conduit (27) connected to the circulation conduit (26) and including a vacuum pump (31) and a pressure control valve (32) arranged between the circulation conduit and the vacuum pump for control of the subatmospheric pressure applied by the vacuum pump in the circulation conduit, said circulation means being formed to circulate superheated steam at subatmospheric pressures to said fibrous material so as to vaporize the residual liquid contained within the fibrous material, said pressure control valve being formed to open as the pressure in said circultion circuit rises to a predetermined higher subatmospheric value and to close as the pressure in said circulation circuit drops to a predetermined lower subatmospheric value, said vacuum pump being formed to thereby intermittently withdraw the steam corresponding to the vaporized liquid through said pressure control valve.

7. The apparatus as claimed in claim 6, characterized in that the continuous flow heater (20) is a vapor operated heat exchanger.

8. The apparatus as claimed in claim 6, characterized in that a continuous flow cooler (28) is installed in the branch conduit (27).

9. The apparatus as claimed in claim 8, characterized in that the continuous flow cooler (28) is a water operated heat exchanger.

10. The apparatus as claimed in claim 6, characterized in that a condenser (28) is arranged in the branch conduit (27).

11. The apparatus as claimed in claim 6, characterized in that a live steam supply line (24) is provided and opens into the circulation circuit (26).

12. The apparatus as claimed in claim 6, wherein said pressure control valve and said continuous flow heater are formed so as to be adjustable to suit a degree of dryness of the fibrous material.

13. An apparatus for drying a fibrous material containing a residual liquid, comprising a vessel (1) which receives the fibrous material (7), a circulation conduit (26) in which the vessel (1), a circulation means (16) and a continuous flow heater (20) are installed, a branch conduit (27) connected to the circulation conduit (26)

and including a vacuum pump (31) and a pressure control valve (32) arranged between the circulation conduit and the vacuum pump for control of the subatmospheric pressure applied by the vacuum pump in the circulation conduit, a continuous flow cooler (28) installed in the branch conduit (27) and formed as a water operated heat exchanger, and a dehydration tank (10) including a liquid discharge line (11) installed in the circulation conduit (26) downstream of the vessel (1) and upstream of the branch conduit (27) leading to the vacuum pump (31).

14. The apparatus as claimed in claim 13, characterized in that the branch conduit (27) is connected to the circulation conduit (26) downstream of the circulation means (16) and upstream of the continuous flow heater (20).

* * * * *